US009068540B2

(12) United States Patent
Rapp et al.

(10) Patent No.: US 9,068,540 B2
(45) Date of Patent: Jun. 30, 2015

(54) FUEL INJECTOR

(75) Inventors: Holger Rapp, Ditzingen (DE); Helmut Clauss, Eberdingen (DE); Wolfgang Stoecklein, Waiblingen (DE); Bernd Berghaenel, Illingen (DE); Marco Beier, Stuttgart-Feuerbach (DE); Changyi Wang, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 25 days.

(21) Appl. No.: 13/884,772

(22) PCT Filed: Oct. 18, 2011

(86) PCT No.: PCT/EP2011/068143

§ 371 (c)(1),
(2), (4) Date: May 10, 2013

(87) PCT Pub. No.: WO2012/065797

PCT Pub. Date: May 24, 2012

(65) Prior Publication Data

US 2013/0240639 A1 Sep. 19, 2013

(30) Foreign Application Priority Data

Nov. 16, 2010 (DE) ..... 10 2010 044 012

(51) Int. Cl.
*F02M 47/02* (2006.01)
*F02M 57/00* (2006.01)

(52) U.S. Cl.
CPC ..... *F02M 57/005* (2013.01); *F02M 47/027* (2013.01); *F02M 2200/16* (2013.01); *F02M 2200/21* (2013.01); *F02M 2200/244* (2013.01); *F02M 2200/247* (2013.01)

(58) Field of Classification Search
CPC ... F02M 47/02; F02M 47/027; F02M 57/005; F02M 2200/16; F02M 2200/21; F02M 2200/24; F02M 2200/244; F02M 2200/247
USPC ..... 239/63, 71, 73, 88–92, 96, 533.2, 239/533.8, 533.9, 585.1–585.5; 123/447, 123/472; 701/103, 104
See application file for complete search history.

(56) References Cited

U.S. PATENT DOCUMENTS

| | | | | |
|---|---|---|---|---|
| 7,918,128 | B2 | 4/2011 | Kondo et al. | |
| 2003/0111049 | A1 | 6/2003 | Lewis | |
| 2009/0241650 | A1* | 10/2009 | Kondo et al. | 73/114.43 |
| 2010/0263633 | A1* | 10/2010 | Kondo et al. | 123/478 |

FOREIGN PATENT DOCUMENTS

| | | |
|---|---|---|
| DE | 102007060395 | 6/2009 |
| DE | 102007063103 | 7/2009 |

(Continued)

OTHER PUBLICATIONS

International Search Report for Application No. PCT/EP2011/068143 dated Feb. 14, 2012 (English Translation and Original, 6 pages).

*Primary Examiner* — Darren W Gorman
(74) *Attorney, Agent, or Firm* — Michael Best & Friedrich LLP

(57) ABSTRACT

The invention relates to a fuel injector for injecting fuel into the combustion chamber of an internal combustion engine, comprising a nozzle needle (1) which is able to perform stroke motions and by the stroke motion of which at least one injection opening can be exposed or closed, and further comprising a control valve (2) for controlling the stroke motion of the nozzle needle (1) in that, depending on the respective switch position of the control valve (2), hydraulic pressure applied in closing direction to the nozzle needle (1) in a control chamber (3) is altered, and further comprising a sensor array (4) for detecting the needle closing time. According to the invention, the sensor array (4) is arranged in the low-pressure area of the fuel injector in a space (5) which is sealed with respect to the fuel-conducting area (6). Sealing of the space (5) is effected by a membrane (7) made of a fuel-resistant, electrically conductive material, allowing the membrane (7) to also be utilized for implementing a ground connection.

11 Claims, 4 Drawing Sheets

(56) References Cited

FOREIGN PATENT DOCUMENTS

| | | | |
|---|---|---|---|
| DE | 102009000983 | | 9/2009 |
| WO | 9717539 | A1 | 5/1997 |
| WO | 2010/127889 | | 11/2010 |
| WO | 2011/085867 | | 7/2011 |

* cited by examiner

FUEL INJECTOR

BACKGROUND OF THE INVENTION

The invention relates to a fuel injector for injecting fuel into the combustion chamber of an internal combustion engine. A fuel injector of this kind comprises a nozzle needle, which is able to perform stroke motions and by the stroke motion of which at least one injection opening can be exposed or closed, and furthermore comprises a control valve for controlling the stroke motion of the nozzle needle. For this purpose, the nozzle needle is acted upon in the closing direction by a hydraulic pressure in a control chamber, which can be varied depending on the respective operating position of the control valve. If the hydraulic pressure in the control chamber decreases, the nozzle needle can open. If the hydraulic pressure rises, on the other hand, the nozzle needle is returned to its seat.

A fuel injector of this kind is disclosed by German Offenlegungsschrift DE 10 2007 060 395 A1. The fuel injector described in this document comprises an on-off valve for actuating an injection valve member. The on-off valve has a closing element, which can be controlled by a magnetic actuator comprising a magnet assembly and an armature. The armature is guided in such a way that it can move on a guide element adjoining the closing element. The guidance of the closing element is assumed by a guide pin accommodated in the guide element and in the closing element. The guide pin and the closing element delimit a pressure chamber, which is connected to the control chamber by a discharge channel. In the closed position of the on-off valve, the hydraulic pressure in the pressure chamber corresponds to the control pressure in the control chamber.

It is furthermore known that the operating behavior of fuel injectors is not constant over the service life thereof. For example, the opening and closing behavior can change due to wear on the moving and/or dynamically stressed components. However, since the opening duration of the nozzle needle has a decisive effect on the fuel quantity injected, it is important to detect such changes and to counteract them.

German Offenlegungsschrift DE 10 2007 063 103 A1 discloses a device for determining an operating behavior of an injection valve of an injection system of an internal combustion engine, which comprises a piezofilm sensor, which can be inserted into the injection valve to determine the closing time of the injection valve. By means of the piezofilm sensor, the impact of the valve needle on the valve seat thereof is advantageously determined. In this way, it is possible to detect whether a predicted time for the impact of the valve needle corresponds to the actual time of the impact. If a deviation is detectable, the control parameters of a control device for the injection system can be adapted accordingly, ensuring that the closing time corresponds to the desired time in future injection processes.

Starting from the abovementioned prior art, it is the underlying object of the present invention to indicate a fuel injector having a sensor arrangement for detecting the needle closing time that is of simple construction and can be produced at low cost.

SUMMARY OF THE INVENTION

The fuel injector proposed comprises a nozzle needle, which is able to perform stroke motions and by the stroke motion of which at least one injection opening can be exposed or closed, and a control valve for controlling the stroke motion of the nozzle needle. The fuel injector furthermore comprises a sensor arrangement for detecting the needle closing time. According to the invention, the sensor arrangement is arranged in the low-pressure region of the fuel injector in a space which is sealed with respect to the fuel-carrying region. The sealing of the space is effected by a diaphragm made of a fuel-resistant, electrically conductive material, allowing the diaphragm to also be utilized for implementing a ground connection. Accordingly, the advantage consists in that the diaphragm is used to implement two functions in a single component, namely the function of sealing and the function of providing a ground connection, if the sensor arrangement requires such a connection. It is thus possible to dispense with a separately constructed ground connection. Moreover, the sealing function ensures protection for the active elements of the sensor arrangement and/or of the contacts thereof from fuel. In order to ensure permanent protection, the material chosen for the diaphragm is a fuel-resistant material which is simultaneously electrically conductive. Suitable materials include, in particular, a metal, e.g. steel. This has a high strength and is thus suitable for bearing pressure oscillations that may occur under certain operating conditions. However, other materials apart from steel can also be used.

According to a preferred embodiment of the invention, the diaphragm is connected, on the one hand, directly or indirectly to the sensor arrangement and, on the other hand, to a housing part of the fuel injector. The connection to the housing serves as a ground connection and can be accomplished at a housing part serving as a supporting plate, for example. The sensor arrangement is preferably supported on the housing part. The housing part can furthermore serve to support individual components of the control valve. The connection is preferably made by means of welding or soldering, thus ensuring a material connection. As an alternative or supplementary measure, the connection can also be achieved by means of clipping or by means of an interference fit, thus providing at least a nonpositive and/or positive connection.

As another preferred option, the sensor arrangement comprises a force-sensitive transducer which operates on a piezoelectric principle and can be acted upon indirectly, via an axially movable force transmission member, by an axial force which is proportional to the hydraulic pressure in the control chamber, at least during a limited time interval. Since the control chamber pressure has a significant minimum at the time of needle closure, the electric signal output by the transducer also has a significant feature. In the case of a transducer operating on a piezoelectric principle, it is, on the one hand, possible to evaluate the voltage output by the element, which has an extreme value at the closing time of the nozzle needle. As an alternative, it is also possible for an element of this kind to be short-circuited via a resistor and for the current output thereby to be evaluated. The current profile will typically have a zero crossing at the closing time of the nozzle needle.

An axially movable armature pin, which is part of the control valve, is preferably used as a force transmission member. According to another preferred embodiment of the invention, the control valve is therefore designed as a solenoid valve and comprises an axially movable armature pin, which can be used as a force transmission member. The armature pin preferably serves a solenoid valve closing element of sleeve-shaped design, wherein, in the closed position of the solenoid valve, the valve closing element and the armature pin delimit a pressure chamber which is connected hydraulically to the control chamber. This ensures that the hydraulic pressure in the pressure chamber corresponds to the control pressure in the control chamber in the closed position of the solenoid valve. The hydraulic pressure which is thus applied to the armature pin is transmitted via the armature pin to the force-sensitive transducer of the sensor arrangement.

As a refinement, it is proposed that a force distributor should be arranged between the force transmission member, preferably the armature pin, and the sensor arrangement. The force distributor has the effect that the axial force exerted by the force transmission member is introduced with a substantially homogeneous surface pressure into the force-sensitive transducer, something that would not be the case if there were direct contact between the armature pin, which is generally embodied with a convex end face, and the transducer. The force transmitter can furthermore be connected to the diaphragm and thus likewise serve to seal the space in which the sensor arrangement is accommodated. In order to produce a ground connection for the sensor arrangement via the force distributor and the diaphragm, the force distributor is preferably also made of an electrically conductive material.

It is furthermore proposed that the diaphragm should be elastic, preferably having elasticity of shape. The diaphragm is thus capable of absorbing pressure oscillations transmitted by the force distributor to the diaphragm. The elasticity of shape can be brought about, for example, by the diaphragm having at least one compensating bend. That is to say that the diaphragm is preferably of corrugated configuration with one or more compensating bends. In the case of a plurality of compensating bends, they are preferably concentric with one another.

BRIEF DESCRIPTION OF THE DRAWINGS

Preferred embodiments of the invention are described in greater detail below with reference to the drawings, in which.

DETAILED DESCRIPTION OF THE DRAWINGS

Figure 1:
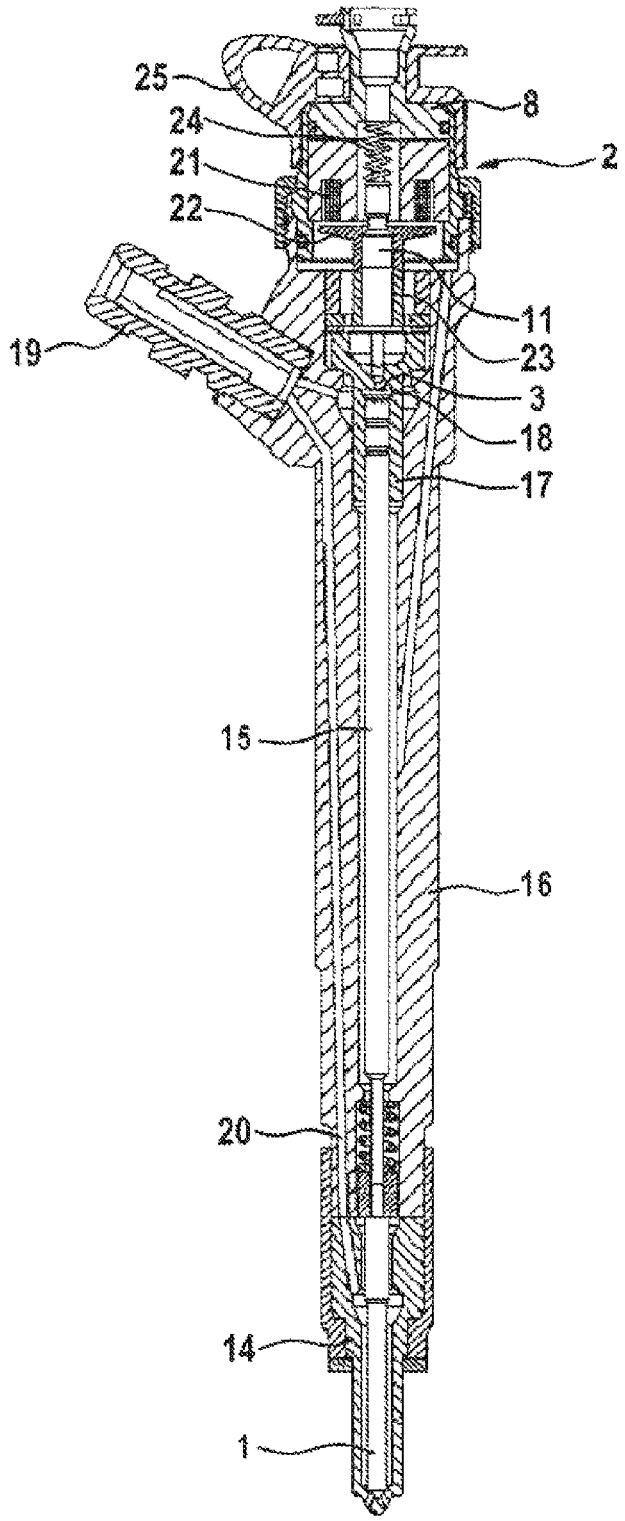
FIG. 1 shows a longitudinal section through a fuel injector known from the prior art.

The known fuel injector illustrated in FIG. 1 has a nozzle needle 1, which is guided in a manner which allows it to perform stroke motions in a nozzle body 14 and on which a valve plunger 15 is mounted as an extension. The valve plunger 15 is likewise guided in a manner which allows it to perform stroke motions in an injector body 16, and is accommodated in a valve piece 17 at its end remote from the nozzle needle 1. Within the valve piece 17, the valve plunger 15 delimits a control chamber 3, in which a hydraulic pressure acting upon the valve plunger 15 and hence upon the nozzle needle 1 in the closing direction prevails in the closed position of a control valve 2, which is designed as a solenoid valve. The hydraulic pressure in the control chamber 3 acting upon the nozzle needle 1 in the closing direction is ensured by means of an inlet restrictor 18, which is connected to a high-pressure port 19 for the supply of fuel under high pressure. The high-pressure port 19 is furthermore connected to a high-pressure bore 20, via which the fuel under high pressure is fed to the sealing seat between the nozzle body 14 and the nozzle needle 1 and from there to at least one injection opening of the fuel injector when the sealing seat is open.

The control valve 2, which is designed as a solenoid valve, comprises an electromagnet 21, which interacts with an armature element 22. Accommodated in the armature element 22 is an armature pin 11, which is guided by a guide 23 in a manner which allows it to perform stroke motions. Moreover, the armature pin 11 is supported on the housing part 8 by way of a spring element 24. An electrical terminal 25 is furthermore provided on the housing.

Figure 2:
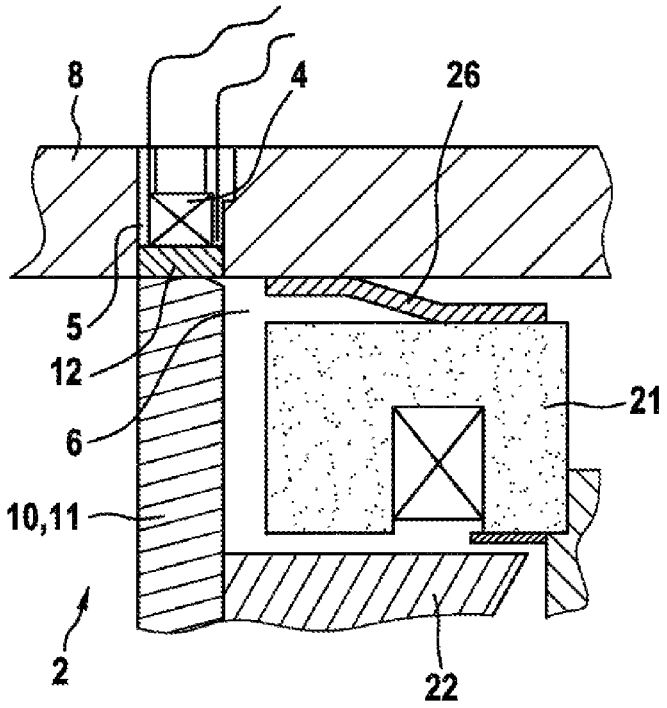
FIG. 2 shows a portion of a longitudinal section through a fuel injector having a sensor arrangement.

FIG. 2 shows a detail of a fuel injector of similar construction in the region of the control valve 2 and of a sensor arrangement 4. The sensor arrangement 4 is accommodated in a space 5, which is sealed with respect to the fuel-carrying region 6 by means of a body that serves as a force distributor 12. Resting against the force distributor 12 as a force transmission member 10 is an armature pin 11, the other end of which delimits a pressure chamber, which is connected hydraulically to a control chamber 3 (similarly to the illustrative embodiment in FIG. 1). Since the control chamber pressure has a significant minimum at the needle closing time, the load chain comprising the armature pin 11 and the force distributor 12 enables this value to be transmitted to the sensor arrangement 4, and therefore the needle closing time can be detected by means of a signal output by the sensor arrangement 4. The armature pin 11 is part of a control valve 2 designed as a solenoid valve, which comprises an electromagnet 21 and an armature element 22, which interacts with the electromagnet 21. The electromagnet 21 is supported by way of a spring element 26 on a housing part 8 of the fuel injector, which also forms the space 5 for accommodating the sensor arrangement 4. The force distributor 12 is likewise inserted into the housing part 8 and thus seals the space 5 with respect to the fuel-carrying region 6.

Figure 3:
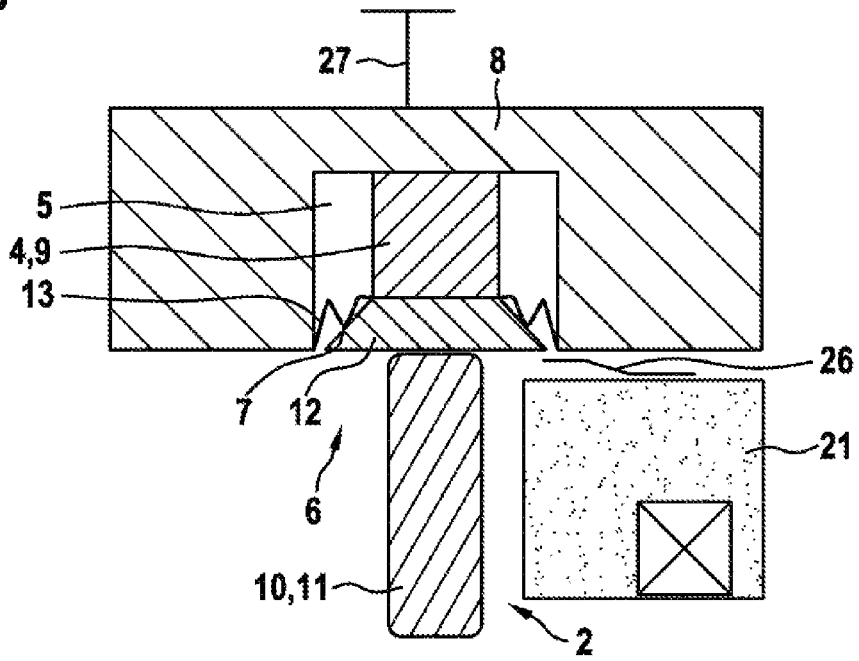
FIG. 3 shows a schematic section through a first embodiment of a fuel injector according to the invention in the region of the sensor arrangement, and FIGS. 4*a-e* each show a schematic section through an alternative embodiment of a fuel injector according to the invention in the region of the sensor arrangement.
Figure 4A:
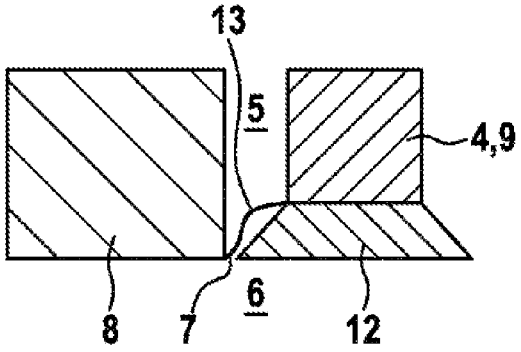
Figure 4B:
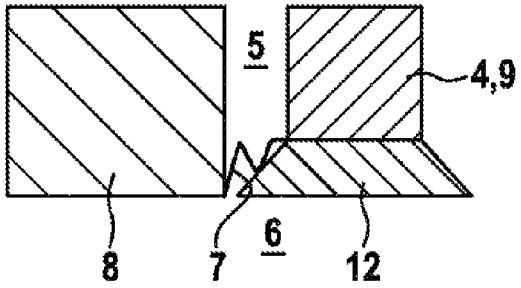
Figure 4C:
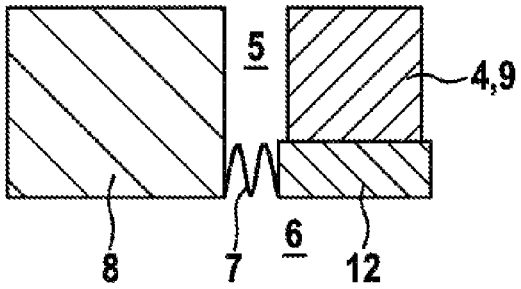
Figure 4D:
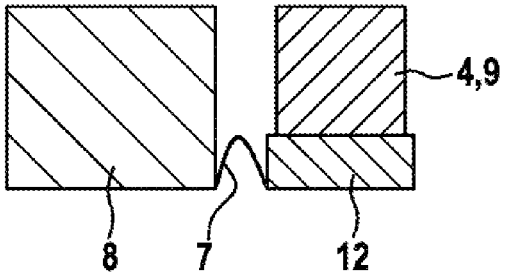
Figure 4E:
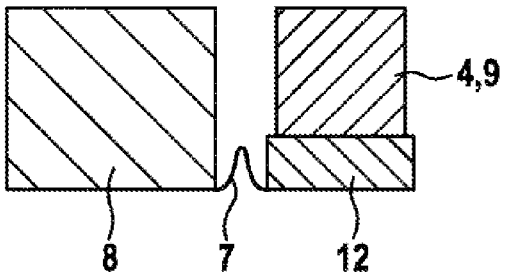

FIG. 3 shows a first preferred embodiment of a fuel injector according to the invention, which is likewise illustrated only as a detail in FIG. 3. The control valve 2 provided to actuate the nozzle needle 1 is likewise designed as a solenoid valve and comprises an electromagnet 21, which interacts with an armature element 22. For the sake of simplicity, only the electromagnet 21 is indicated in FIG. 3, said electromagnet being supported by way of a spring element 26 on a housing part 8 serving as a supporting plate. The control valve 2 furthermore comprises an armature pin 11, which can once again be used as a force transmission member 10 since it is supported by one end face on a force distributor 12 operatively connected to a sensor arrangement 4 and, with its other end face, delimits a pressure chamber (not shown specifically), which is connected hydraulically to a control chamber 3 (similarly to the embodiment in FIG. 1). Via the armature pin 11, a pressure force can thus be transmitted to the force distributor 12 and absorbed by the sensor arrangement 4. For this purpose, the sensor arrangement 4 comprises a force-sensitive transducer 9, which preferably operates on a piezoelectric principle. The sensor arrangement 4 is arranged in a space 5, which is formed in the housing part 8 and is sealed with respect to a fuel-carrying region 6 by a thin metal diaphragm 7. The sensitive elements of the sensor arrangement 4 are thus protected from fuel. Moreover, the metal diaphragm 7 performs another function since it simultaneously serves as a ground connection for the sensor arrangement 4. To achieve this, the diaphragm 7 is formed from an electrically conductive material and, on the one hand, is connected directly or indirectly to the sensor arrangement 4 and, on the other hand, to the housing part 8. A material connection, e.g. by means of welding, is preferred. However, the metal diaphragm 7 can also be press-fitted into the housing 8 or onto the force distributor 12 or the sensor arrangement 4. The connection must be configured in such a way that a ground connection is ensured. In addition to the diaphragm 7, the sensor arrangement 4 has a further ground connection 27.

Various examples of the attachment of the diaphragm 7 to the housing part 8 and the sensor arrangement 4 or force distributor 12 are illustrated schematically in FIGS. 4*a-e*. In order to enable pressure oscillations to be absorbed, the diaphragm 7 is of elastic design. The elasticity of the diaphragm 7 is effected by means of at least one compensating bend 13. The design of the diaphragm 7 is not exhausted by the specific illustrative embodiments shown in FIGS. 4*a-e*, and it can therefore be modified in any desired manner. Moreover, modifications of a fuel injector according to the invention such that some other force transmission member 10 is used instead of an armature pin 11 are possible. It is furthermore not absolutely essential to design the control valve 2 as a solenoid valve.

By virtue of the fact that a fuel injector according to the invention has means for detecting the needle closing time, not only is the dynamic behavior of the control valve 2 but also all possible inaccuracies within the entire operating chain from the actuator to the nozzle needle 1 are taken into account in determining the injection duration and hence injection quantity. This makes it possible to compensate both for manufacturing tolerances between valves of the same kind and also for the drift of said valves over the service life thereof and for the influence of variable influencing factors, such as the influence of pressure oscillations. The fuel quantity injected can thus be determined and set with higher accuracy, and this in turn has a positive effect on fuel consumption and the associated emissions. At the same time, the fuel injector according to the invention is of simple construction and consequently economical to produce in comparison with other fuel injectors comprising means for detecting the needle closing time.

The invention claimed is:

1. A fuel injector for injecting fuel into the combustion chamber of an internal combustion engine, the fuel injector having a nozzle needle (1), which is able to perform stroke motions and by the stroke motion of which at least one injection opening can be exposed or closed, and having a control valve (2) for controlling the stroke motion of the nozzle needle (1) in that, depending on the respective operating position of the control valve (2), a hydraulic pressure in a control chamber (3) acting upon the nozzle needle (1) in the closing direction is altered, and further having a sensor arrangement (4) for detecting the needle closing time, characterized in that the sensor arrangement (4) is arranged in a low-pressure region of the fuel injector in a space (5) which is sealed with respect to a fuel-carrying region (6), and the sealing of the space (5) is effected by a diaphragm (7) made of a fuel-resistant, electrically conductive material, allowing the diaphragm (7) to also be utilized for implementing a ground connection, wherein the diaphragm (7) is connected directly or indirectly to the sensor arrangement (4) and to a housing part of the fuel injector.

2. The fuel injector as claimed in claim 1, characterized in that the sensor arrangement (4) comprises a force-sensitive transducer (9) which operates on a piezoelectric principle and can be acted upon indirectly, via an axially movable force transmission member (10), by an axial force which is proportional to the hydraulic pressure in the control chamber (3).

3. The fuel injector as claimed in claim 2, characterized in that the control valve (2) is designed as a solenoid valve and comprises an axially movable armature pin (11), which can be used as the force transmission member (10).

4. The fuel injector as claimed in claim 2, characterized in that a force distributor (12) is arranged between the force transmission member (10) and the sensor arrangement (4).

5. The fuel injector as claimed in 1, characterized in that the diaphragm (7) is elastic.

6. The fuel injector as claimed in claim 1, characterized in that the diaphragm (7) has at least one compensating bend (13).

7. The fuel injector as claimed in claim 1, characterized in that the sensor arrangement (4) comprises a force-sensitive transducer (9) which operates on a piezoelectric principle and can be acted upon indirectly, via an axially movable force transmission member (10), by an axial force which is proportional to the hydraulic pressure in the control chamber (3).

8. The fuel injector as claimed in claim 7, characterized in that the control valve (2) is designed as a solenoid valve and comprises an axially movable armature pin (11), which can be used as the force transmission member (10).

9. The fuel injector as claimed in claim 8, characterized in that a force distributor (12) is arranged between the force transmission member (10) and the sensor arrangement (4).

10. The fuel injector as claimed in claim 3, characterized in that a force distributor (12) is arranged between the force transmission member (10) and the sensor arrangement (4).

11. The fuel injector as claimed in claim 5, characterized in that the diaphragm (7) has elasticity of shape.

* * * * *